United States Patent [19]

Sandor

[11] Patent Number: 4,531,612

[45] Date of Patent: Jul. 30, 1985

[54] ESCAPE LADDER

[76] Inventor: Jules A. Sandor, 12012 Bambi Pl., Granada Hills, Calif. 91344

[21] Appl. No.: 651,478

[22] Filed: Sep. 17, 1984

[51] Int. Cl.[3] ..... E06C 1/56; E06C 7/08

[52] U.S. Cl. ..... 182/196; 182/63; 182/178; 182/206

[58] Field of Search ..... 182/178, 63, 196, 197, 182/198, 206

[56] References Cited

U.S. PATENT DOCUMENTS

| | | | |
|---|---|---|---|
| 195,161 | 9/1877 | Philbrook | 182/206 |
| 296,145 | 3/1884 | Davis | 182/206 |
| 331,736 | 12/1885 | Rose | 182/196 |
| 342,924 | 6/1886 | Nordenborg | 182/206 |
| 869,151 | 10/1907 | Zube | 182/196 |
| 3,834,492 | 9/1974 | Ronk | 182/196 |
| 3,907,064 | 9/1975 | Svalberg | 182/196 |
| 4,254,846 | 3/1981 | Soave | 182/2 |

*Primary Examiner*—Reinaldo P. Machado
*Attorney, Agent, or Firm*—Sanford Astor

[57] ABSTRACT

The invention relates to a portable emergency fire escape ladder comprising a large double hook adapted to fit over a window ledge, tubular steps suspended by means of galvanized steel cables, the steps secured on the suspension cables by means of pressed steel rings. The tubular steps are slightly larger in diameter at one end than the other allowing the steps to join together to form a pole. There is a connecting rod under the double hook for the attachment of the top tubular step in the pole position. The double hook has a curvature at the lower end in order that the tubular steps may be spaced a distance from the wall to allow room for the person's foot. The double hook is provided with a pull cable which is strung through the frame of the double hook, to the end pieces, so that pulling on the cable will release the double hook from the window ledge allowing a person down the wall.

9 Claims, 6 Drawing Figures

ESCAPE LADDER

BACKGROUND OF THE INVENTION

With the huge increase in numbers of tall office buildings, condominiums, and apartment buildings, and with the large number of fires that have occured in these buildings in recent years, there is a great need for a reliable, simple and usable fire escape ladder which may be kept by persons for portable use.

While ordinary rope ladders which hook over a window sill are well known, they suffer from many problems. Most of them are too heavy and cumbersome for use. They can be made only of a given length so that only a certain distance can be traveled on the ladder. They are then fixed on the window ledge where they were set, and cannot be removed from the ledge. Certain devices have been proposed for hooks that are removable from the ledge, but these require complex mechanical devices.

Quite often in fire situations today, it is more beneficial for the party to escape by going upward to the roof than it is to go down. No fire escape ladder, known today, allows that ability.

OBJECTS OF THE INVENTION

The invention will now be described by reference to the following drawings in which.

Figure 1:
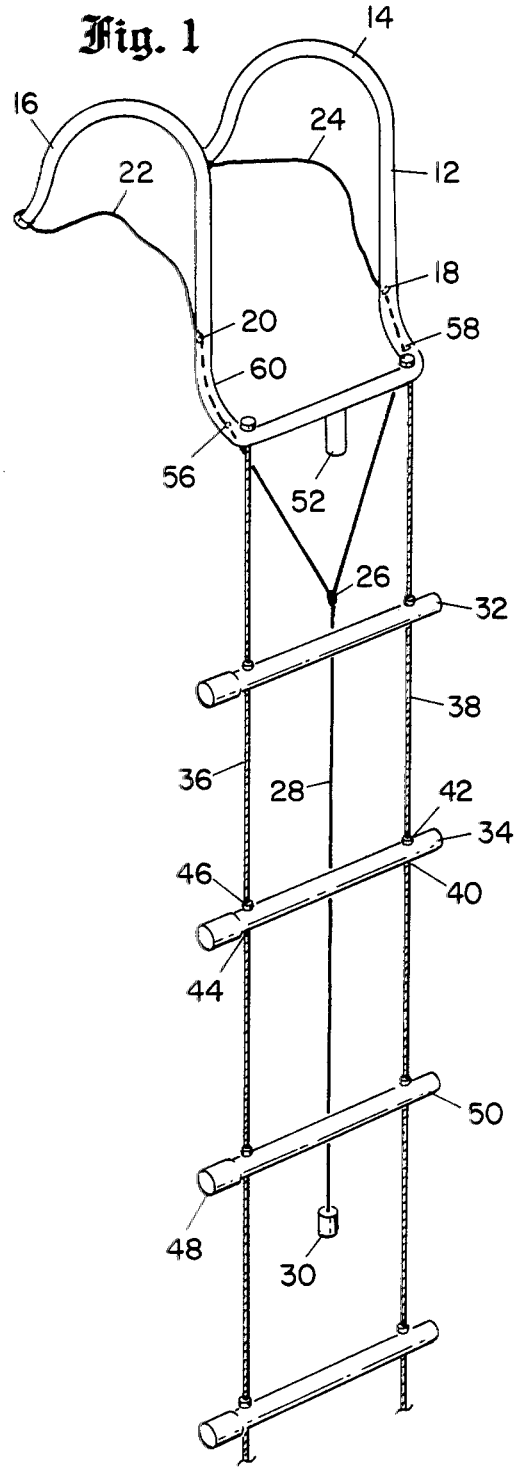
FIG. 1 is a perspective view of the ladder of the present invention.
Figure 2:
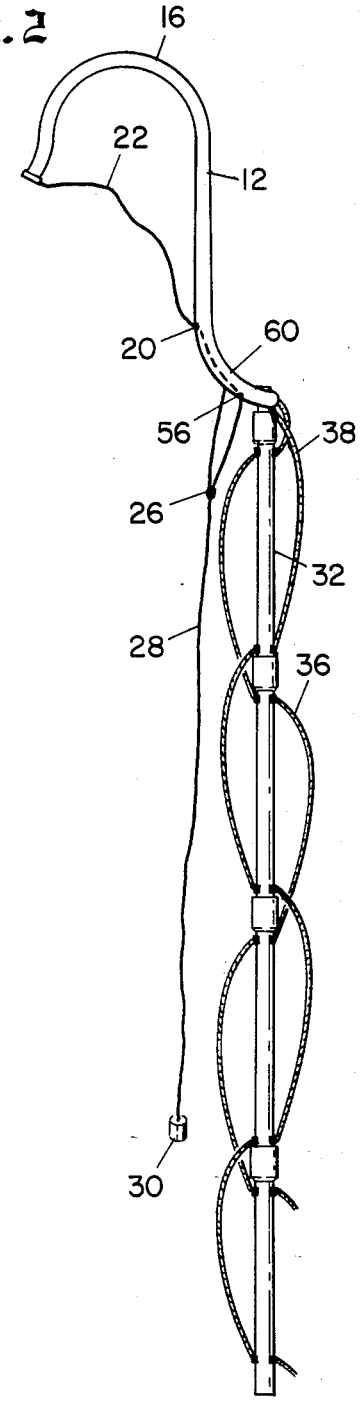
FIG. 2 is a side view of the ladder.

Referring now to FIGS. 1 and 2 there is shown the ladder of the present invention 10. The ladder comprises an essentially "u" shaped double hook portion 12 with two hooked arms 14 and 16. The double hook portion 12 has two holes 18 and 20; one in each arm of the hook, 14 and 16 adapted for passage of two pieces of cable 22, 24 which are fixedly attached to the ends of the double hook 14 and 16, pass through holes 18 and 20 then through holes 56, 58, join together at point 26, into a single cable 28 which ends in a pull cord handle 30.

The steps of the ladder 32, 34, etc. are connected together by steel cable 36, 38. The steps 32, 34 are held onto the steel cable by steel rings 40, 42, 44, and 46 to hold the steps in a fixed position on the cable.

Each of the steps 32, 34, etc. has a larger diameter end 48 and a small diameter end 50.

In FIG. 1 the ladder is shown in the hanging position in which it would be placed over a window ledge.

In FIG. 2 the ladder is shown in a pole position in which the tubular steps are inserted one into the other, the small diameter end being placed in the next steps larger diameter end to form a pole. The top rung of the ladder 32, is then placed over a connecting pin 52 which is fixedly attached to the under side of the double hook 12. In this position, the entire ladder forms a pole which may be raised by the user to the window ledge above his level, hooked over the window ledge, the steps of the ladder then pulled apart, into the ladder position, and used to go up a floor rather than down.

Figure 3:
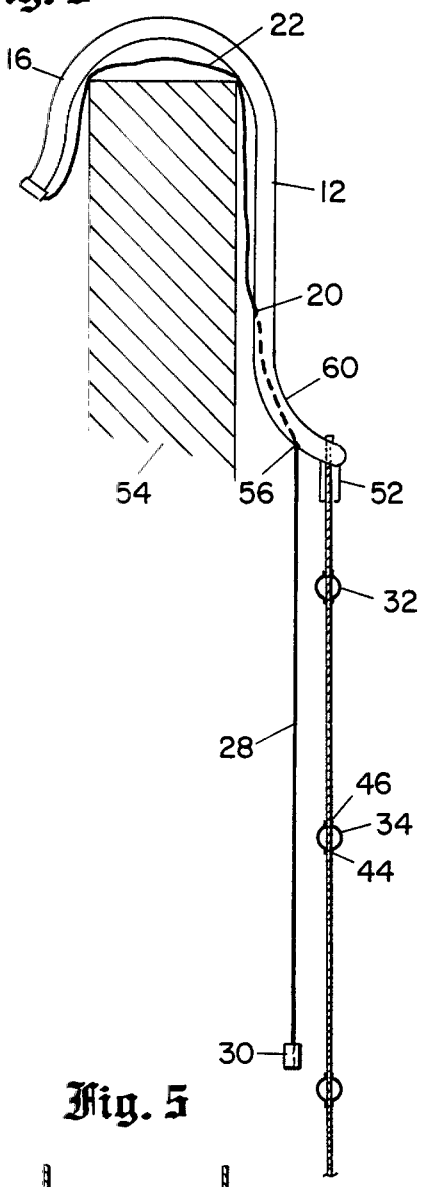
FIG. 3 is a side view of the ladder showing the detail of the removal mechanism.
Figure 4:
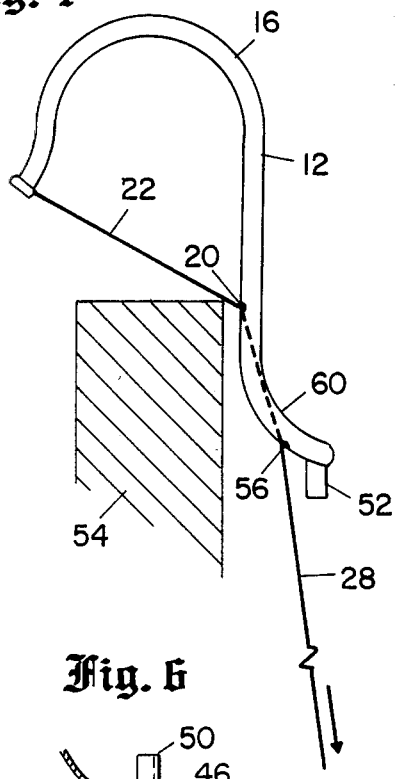
FIG. 4 is a side view of the hook portion of the ladder showing its removal from the wall.

Referring now to FIGS. 3 and 4 there is shown the double window hooks 12 with hook portion 16 and release cable 22 attached to the end of the hook portion 16. The rungs of the ladder 32, 34, etc. hooked onto the cables 36 by rings 44 and 46. The double hook portion 12 is shown placed over the wall or window ledge 54.

As can be seen more clearly in FIGS. 3 and 4 the release cable 22 passes through hole 20 and then through a second hole 56 so that it will hang straight down behind the ladder and be available for the pulling of the handle 30. As clearly shown in FIG. 4 when the party reaches the level and steps off the ladder, by pulling steadily on pull cord 30, the release cable 28 lifts the double hook 12 off the wall 54, so that it will drop down and can be caught by the person so that he can proceed down to another floor.

Figure 5:
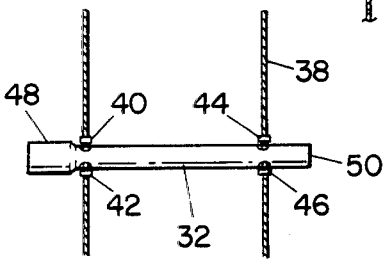
FIG. 5 is a detailed view of the tubular steps of the invention.

Referring now to FIG. 5 there is shown in more detail, a step 32, of the ladder with its smaller diameter end 50 and its larger diameter end 48. The steel cable 36, 38 has the step 32 fixed in position by steel rings 40, 42, 44 and 46.

Figure 6:
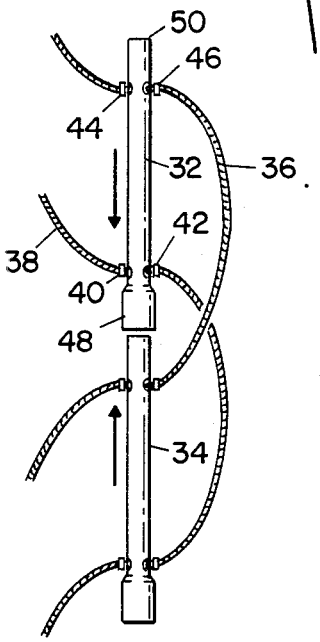
FIG. 6 is a detailed view of the tubular steps of the present invention when set in the pole position.

There is shown in FIG. 6 a more detailed view of the steps in the tubular position. Two adjacent steps 32 and 34 are place in the vertical position and the small end of step 34 is placed into the large end of the step 32 so that they may be hooked into position. By continuing each adjacent step in this manner the ladder is placed in a pole position so that it can be raised to the floor above. The distance between the steps must be sufficient to allow the steps to join end to end.

The steel cable 36 and 38 may be made of any convenient material, however galvanized steel cable of about 2/8 inch diameter gives fireproof strength and still is lightweight. The steps are best constructed of a high resistant aluminum tube to provide less weight for the total ladder. Double hook portion 12 has a lower curvature 60 which holds the suspended ladder a proper distance from the wall to accomodate the foot comfortably without interfering with the wall.

When the ladder is in the pole position and it is placed in a window opening on a ledge on the floor above and just a pull downward on the pole will deploy the ladder and have it ready to climb it upward. To go up more than one story, just repeat this process at each floor.

To go down with the ladder, just engage the hook on the window opening, climb down, pull the pull cord 30 to release the ladder and then place it on the lower window opening and go down another floor.

The personal, portable fire escape ladder of this invention is a flexible ladder but it permits the user to escape from the fire either in an upward or downward direction. It is constructed of ultra-light material and has a weight of only 2.2 kilograms. It is totally fire resistant. While it is a personal escape ladder, it can support a load of 1000 lbs. It is perfectly safe and no accidental un-hooking is possible while using the ladder. It is very compact for storage with simple construction without any complicated mechanical devices that may fail. Having thus described the invention it is requested that the scope of the invention be defined only by the attached claims.

I claim:

1. An emergency fire-resistant escape ladder comprising hooking means to engage the ladder over a wall or ledge, a plurality of steps larger in diameter at one end and adapted to interlock by fitting the smaller end into the larger end of the adjacent step, the steps held together by a pair of cables, a release cable attached to the hooking means adapted to release the hooking means from the ledge.

2. The device of claim 1 in which the steps are attached to the pair of cables by rings.

3. The device of claim 1 in which the distance between steps allow sufficient cable length to attach the adjacent steps end to end.

4. The device of claim 1 in which the means to engage the ladder comprises a "u" shaped double hook.

5. The device of claim 1 in which the release cable is attached to the upper ends of the "u" shaped double hook and passes through holes in the lower ends of the "u" shaped double hook.

6. An emergency fire-resistant escape ladder comprising a "u" shaped double hook having a upper curvature and a lower curvature adapted to engage the ladder over a wall, ledge or sill, a plurality of steps larger in diameter at one end and smaller at the other end held together by a pair of cables, the cables having sufficient length to allow engagement of adjacent steps one to the other by the placing of the smaller end of one step into the larger end of the adjacent step forming a pole, a release cable attached to the upper curvature and then to the lower curvature of the double hook.

7. The device of claim 6 in which the steps are tubular.

8. The device of claim 6 in which the double hook contains a first set of holes for passage of the release cable and a second set of holes for passage of the release cables.

9. The device of claim 6 in which the steps are fixed to the pair of cables by rings.

* * * * *